United States Patent [19]

Bettcher

[11] Patent Number: 5,023,953

[45] Date of Patent: Jun. 18, 1991

[54] GARMENT AND PROTECTIVE SLEEVE

[75] Inventor: Laurence A. Bettcher, Huron, Ohio

[73] Assignee: Bettcher Industries, Inc., Birmingham, Ohio

[21] Appl. No.: 625,691

[22] Filed: Dec. 12, 1990

Related U.S. Application Data

[63] Continuation of Ser. No. 537,059, Jun. 12, 1990, abandoned.

[51] Int. Cl.[5] ..... A41D 27/10; A41D 13/08; A41D 27/12

[52] U.S. Cl. ..... 2/126; 2/16; 2/51; 2/59

[58] Field of Search ..... 2/126, 16, 51, 125, 2/59

[56] References Cited

U.S. PATENT DOCUMENTS

| | | | |
|---|---|---|---|
| 264,195 | 9/1882 | Quinn | 2/126 |
| 731,791 | 6/1903 | Krifka | 2/16 |
| 1,045,737 | 11/1912 | Paradis | 2/269 |
| 1,066,219 | 7/1913 | Paradis | 2/269 |
| 1,075,010 | 10/1913 | Casebolt | 2/126 |
| 1,266,182 | 5/1918 | Vidette | 2/269 |
| 2,150,069 | 3/1939 | Koleno | 2/59 |
| 2,428,158 | 9/1947 | Hermer | 2/124 |
| 2,807,804 | 10/1957 | Miller | 2/126 |
| 3,024,466 | 3/1962 | Agostini | 2/126 |

FOREIGN PATENT DOCUMENTS

| | | | |
|---|---|---|---|
| 263951 | 12/1949 | France | 2/126 |

OTHER PUBLICATIONS

The Whizard® cut-resistant Armgvard II Medium and Heavy Duty, 1989, Form 789.

*Primary Examiner*—Werner H. Schroeder
*Assistant Examiner*—Gloria Hale
*Attorney, Agent, or Firm*—Watts, Hoffmann Fisher & Heinke

[57] ABSTRACT

A sleeveless shirt and a detachable cut-resistant full length protective sleeve. The sleeveless shirt has a neck, a front panel, a back panel, a yoke panel and two elongated tabs secured to the yoke panel, one on each shoulder of the wearer. The tabs each have fasteners which are one part of a two part fastening system. The detachable cut-resistant sleeve has a tightening system, a placket and the second part of the fastening system. The fastening system is utilized to connect the detachable sleeve to the sleeveless shirt. The combination is utilized to protect the wearer's arm from injury while the wearer is engaged in activities in the meat packing industry.

12 Claims, 3 Drawing Sheets

GARMENT AND PROTECTIVE SLEEVE

This is a continuation of copending application Ser. No. 07/537,059 filed on 6/12/90 abandoned .

DISCLOSURE OF THE INVENTION

This invention relates to wearing apparel and particularly to a shirt for use in the meat packing industry for supporting a detachable protective sleeve, and the combination of the two.

BACKGROUND OF THE INVENTION

In the meat packing industry, workers using cutting implements wear protective clothing, including arm protectors that are cut resistant and that protect against injury. These protectors are often in the form of a sleeve and have typically been retained on a worker's arm by pinning the sleeve to the worker's clothing or by binding the top of the sleeve in a manner to tighten it around the worker's arm to inhibit it from sliding down during use. It is, of course, difficult to pin the sleeve on without assistance and tightened sleeves that are not pinned tend to slip down, which exposes the worker to danger.

The present invention provides a separate shirt and removable protective sleeve supported by the shirt. The shirt is specially constructed to meet the needs of the meat packing industry and to be wearable as an overgarment with the worker's ordinary work clothing. To that end, it must be light in weight, loose fitting, smooth, and flexible to avoid interfering with the worker's freedom of movement. It must also be thin, cool and porous because some workers are in a very warm atmosphere, as on the kill floor, and others work in a partially refrigerated atmosphere, and both do not wish to add to the effect and especially not to the bulk of their existing clothing when wearing the shirt that supports the protective sleeve. In addition, the shirt must provide stable support across the upper shoulder area to retain the sleeve in a position fully covering the arm notwithstanding the active movements required by the worker's tasks.

SUMMARY OF THE INVENTION

The invention provides both a novel shirt for supporting a protective sleeve and the combination of the shirt and a protective sleeve supported in a manner that achieves the desiderata stated above and retains the sleeve in an adjustable and conveniently removable and attachable way.

In its broader aspects the shirt of the present invention is a sleeveless shirt constructed to support a detachable cut-resistant protective sleeve, for use in the meat packing industry, and comprises a neck; a front panel and a back panel, each of a thin, light weight, low friction, wear-resistant, mesh material, and joined together to form side seams of the shirt that extend between a tail end and an upper end and that terminate before the upper end of the shirt to provide side openings at the upper end of the shirt for a wearer's arms to extend, the front panel forming a partial boundary of the neck; a yoke panel extending the width of the front and back panels, in part forming the side openings, said yoke panel being of a woven relatively heavyweight material, such as cotton, and relatively non-stretchable compared to the front and back panels; and two elongated tabs of elasticized webbing, each fastened at one end to the yoke, one on each side of the shirt and extending out from the shirt at the top of the side openings, for a distance less than the distance from the neck to the side opening, and each having two fasteners that are each one part of a two-part system, the two fasteners being aligned and spaced along the length of the carrying tab.

In its broader aspects, the combination of the shirt and protective sleeve additionally includes an elongated protective tubular sleeve separable from the shirt, having a cuff portion at one end, an opposite end, and four fasteners, each being the other part of the two-part system, secured to the sleeve adjacent said opposite end, arranged in two rows of two fasteners each, the rows being spaced peripherally about the sleeve and the fasteners of each row being spaced longitudinally of the sleeve.

The various features and advantages of the invention will become more apparent from the detailed description of a preferred embodiment of the invention when considered along with the accompanying drawings.

BEST MODE FOR CARRYING OUT THE INVENTION

Figure 1:
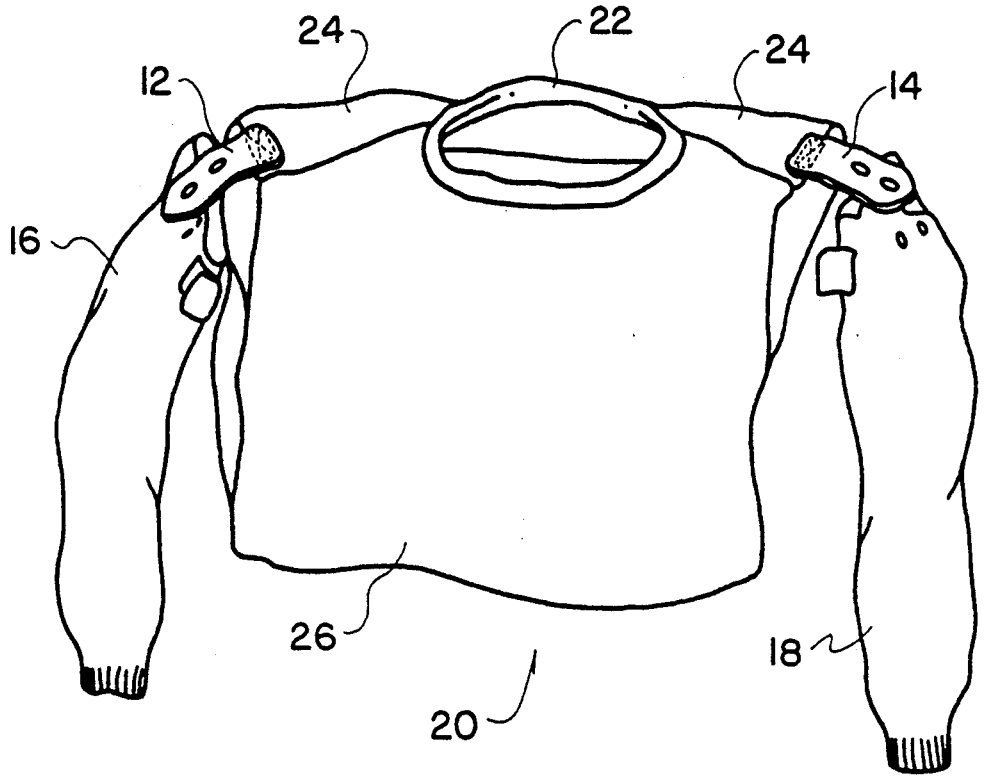
FIG. 1 is a front elevational view of a shirt and protective sleeve embodying the present invention.
Figure 2:
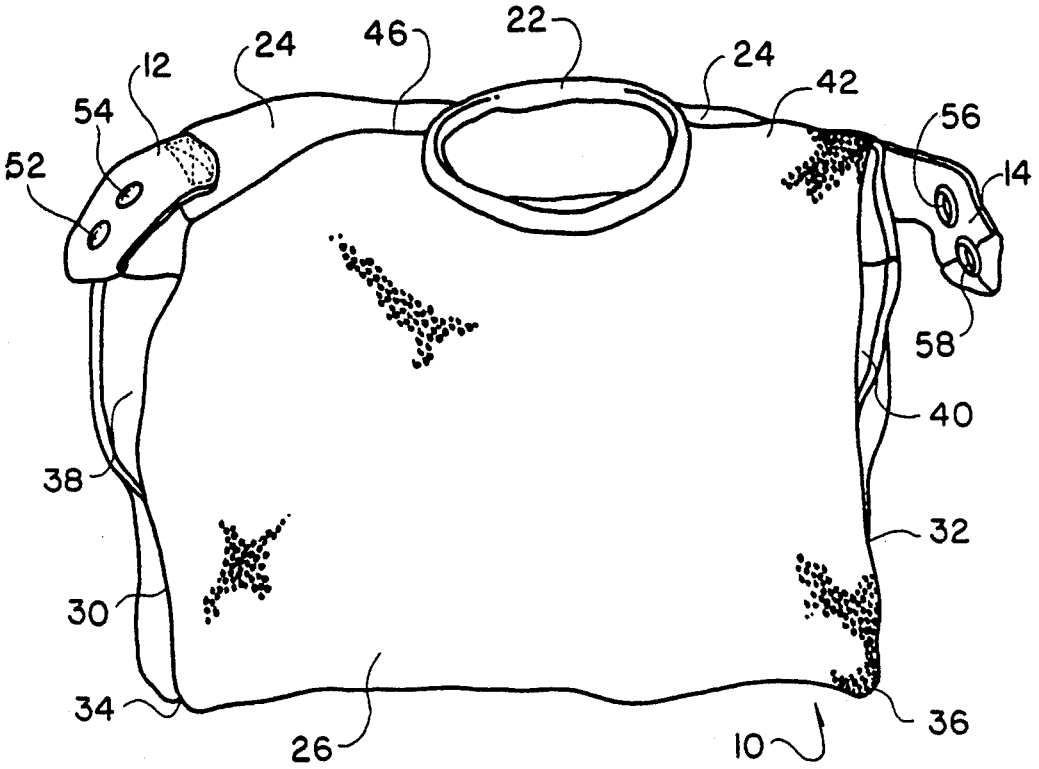
FIG. 2 is a front elevational view of a shirt embodying the present invention.
Figure 3:
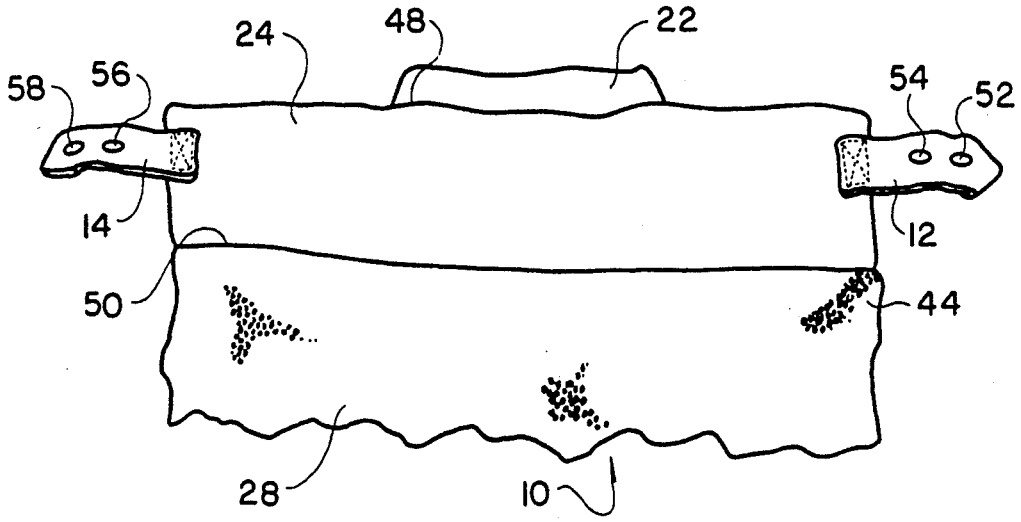
FIG. 3 is a rear elevational view of the shirt of FIG. 2.
Figure 5:
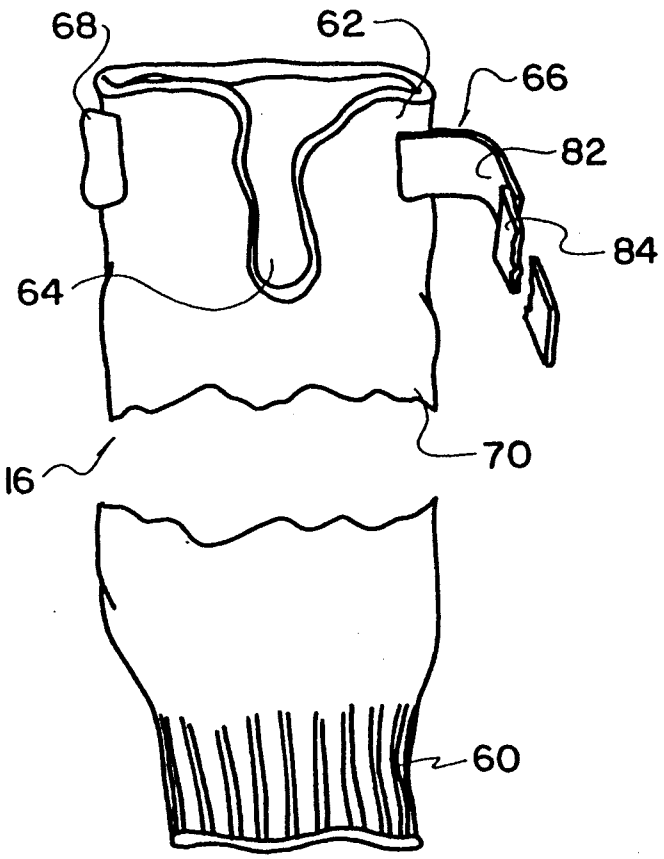
FIG. 5 is a back elevational view of the sleeve of FIG. 4.
Figure 4:
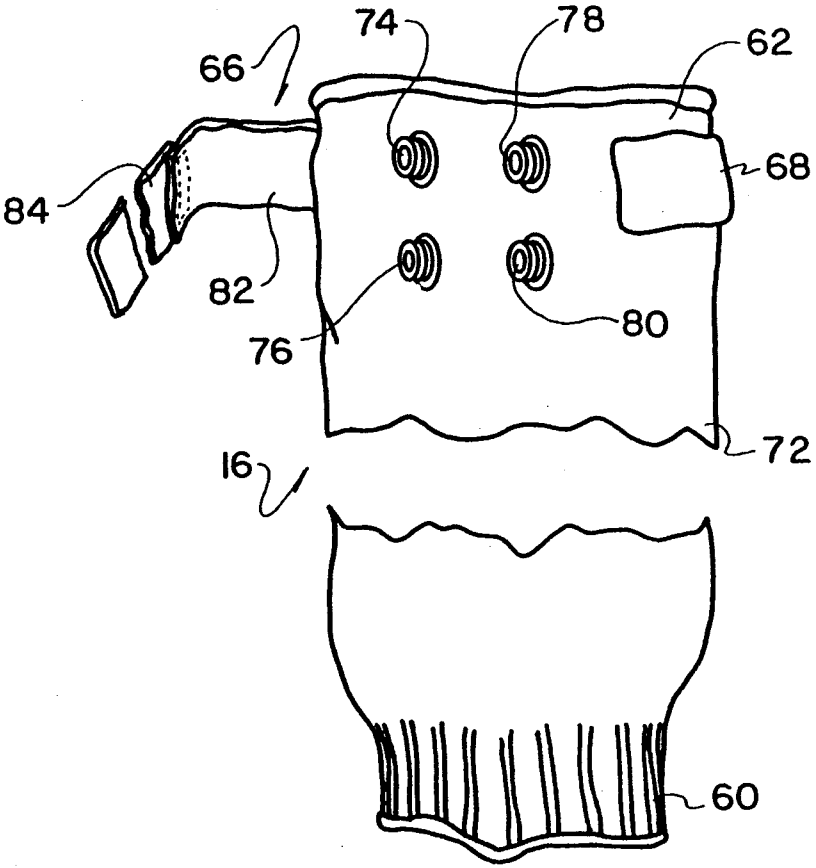
FIG. 4 is a front elevational view of a protective sleeve embodying the present invention.

Referring to the drawings, the present invention is a sleeveless shirt 10 having tabs 12, 14 for connecting and adjusting one or more separate full length sleeves 16, 18 to the shirt in order to protect the wearer's arm while the wearer performs activities relating to meat packing. The invention relates also to the combination of the sleeveless shirt and one or more protective detachable full length sleeve 20 connected to the shirt by way of a fastening system.

The sleeveless shirt 10 has a crew neck 22, a yoke 24, two elongated tabs 12, 14 and single front and back panels 26, 28. The single front and back panels are substantially the same size, and they are essentially rectangular when placed in a flat position. It is desirable that the material selected be thin, light weight, low friction, flexible and smooth as the shirt is to be worn loosely over and cover the wearer's outer clothing and yet not hinder the wearer's freedom of movement. Further, it is desirable that the material selected be thin and porous so as to accommodate the environmental conditions that the worker encounters in the meat packing industry. In the lower temperature environments encountered by the worker a shirt constructed of thin material will not add to the wearer's bulk whereas in the higher temperature environments encountered by the worker, a shirt constructed of porous material will aid in the worker's comfort. Suitable material should have significant give or stretch. Desirable material is 150 denier mesh and made with warp knit or tricot mesh, e.g., 150 denier mesh polyester or 70 denier/2 nylon mesh. The front and back panels are stitched together to form side seams 30, 32 of the shirt. The seams 30, 32 of the shirt extend between a tail end 34, 36 and side openings 38, 40 at the upper end of the shirt for the wearer's arms to project. The front panel is stitched or joined to the crew neck 22 and the yoke 24 along its upper boundary 42. The back panel is stitched or joined to the yoke along the upper boundary 44 of the back panel. Stretchable material is suitable for the crew neck 22.

The yoke 24 extends the width of the front and back panels, essentially behind the neck, and is sewn along an upper edge 46 to the front panels and to a portion 48 of the neck not bounded by the front panel. It is sewn along a lower edge 50 to an upper boundary 44 of the back panel and in part forms the side openings 38, 40 of the shirt.

The yoke panel 24 supports and retains the detachable sleeves in a position to offer full coverage to the arms by the sleeve. It is therefore desirable that the yoke be fabricated of a woven, relatively heavy weight, non-stretchable material in comparison to the material utilized for the front and back panels. A suitable material for the yoke is cotton such as 8 ounce double filled bleached cotton. It is important for the yoke of the shirt to be of a heavy weight material so that it can keep the shirt from stretching out of place when only one sleeve is worn. In addition, a heavy weight material offers stability to the shirt.

The two elongated tabs 12, 14 of elasticized webbing, each fastened at one end to the yoke, one on each side of the shirt, and extend out from the shirt at the top of the adjacent side opening. It is desirable to have the tabs fabricated of an elasticized material that provides some give, yet is stiff enough to maintain an attached sleeve high up on the wearer's arm, thereby ensuring complete protective coverage of the whole arm. Each tab is sewn to the yoke adjacent the edge of the yoke that in part forms the respective side opening 38 and extends from the yoke a distance less than the distance from the neck to the side opening. Each tab 12, 14 has two snap fasteners 52, 54 and 56, 58, respectively, which are one part of a two part fastening system. The fasteners on the tab are aligned and spaced along the length of the tab. Suitable fasteners are large heavy duty snaps with the outer part on the tab and the inner part on the sleeve.

One or two protective sleeves 16, 18 can be worn at a time by the worker. Each sleeve is full length to completely cover the wearer's arm and protect against cuts while the wearer is engaged in cutting or trimming activities in the meat packing industry. An individual sleeve is elongated and tubular in shape and completely detachable or separable from the supporting shirt. It is essential that the sleeve be fabricated of a material that protects the arm from harm, i.e., protecting the wearer from being harmed by meat cutting instruments, e.g., knives. A suitable material is a knit from a high strength, cut-resistant yarn comprised of a core having a stainless steel strand 0.002 to 0.006 inch, preferably 0.002 to 0.004 inch, in diameter and a strand of high strength stretched polyethylene of approximately 650 denier; a first wrap about the core of approximately 400 denier high strength aramid fiber such as Kevlar, a second wrap of approximately 375 denier high strength stretched polyethylene fiber such as Spectra and a third wrap of approximately 440 denier polyester. Sleeves of that material are known.

The sleeve fits over the arm so as to fully cover the arm from the wrist to just below the shoulder. The wrist end 60 or the cuff portion the sleeve is elasticized so as to prevent a loose cuff portion.

The other or upper end of the sleeve 62 is non-elasticized with a "u" shaped gap or placket 64 and a two piece system 66, 68 for tightening the sleeve around the upper arm on one side of the sleeve 70 and on the other side 72 fasteners 74, 76, 78, 80, respectively. The placket extends about four inches from the end toward the cuff portion. The tightening system is comprised of two pieces 66, 68 each attached to either side of the placket 64. The piece 68 is of Velcro completely attached to the sleeve. The other piece 66 is a strip of elasticized material attached to the sleeve at one end 82 and having a piece of Velcro 84 attached to the other end of the strip so that the loose piece of the tightening systems extends across the placket and attaches to the other piece 68 so as to tighten the sleeve about the inner arm for a secure fit.

The sleeve is attached to the support shirt by the connecting fasteners on the carrying tab on the shirt yoke to one or more of the fasteners on the sleeve. The fasteners on the sleeve are then the second part of the two part fastening system that secures the sleeve to shirt. The fasteners are arranged on the sleeve in two rows of two fasteners each, the rows being spaced peripherally about the sleeve and the fasteners of each row being spaced longitudinally of the sleeve. The array of fasteners on the sleeve allows for one sleeve to fit a variety of arm lengths. In addition, the array of fasteners allows the sleeve to be properly fitted to the wearer so that the placket and tightening system are worn on the inside portion of the wearer's arm. In general an array of fasteners adds flexibility in attaching the sleeve to the shirt.

The shirt can be worn with one sleeve or two attached.

The present invention has been described with a degree of particularity. It is the intent, however, that the invention include all modifications and alterations from the disclosed embodiments falling within the spirit or scope of the appended claims.

I claim:

1. The combination of a sleeveless shirt and a detachable cut-resistant protective sleeve for use in the meat packing industry, comprising:

a) a sleeveless shirt having i) a crew neck, ii) a single front panel and a single back panel, each substantially rectangular when flat and of a thin, light weight, low friction, wear-resistant, mesh material having significant give or stretch, and stitched together to form side seams of the shirt that extend from a tail end toward an upper end and that terminate before the upper end of the shirt to provide side openings at the upper end of the shirt for a wearer's arms to extend therethrough, the front panel forming a partial boundary of the neck, iii) a single yoke panel extending the width of the front and back panels, located essentially behind the neck and forming the remaining boundary of the neck and in part forming the side openings, said yoke panel being of a woven relatively heavy weight material and relatively non-stretchable compared to the front and back panels, and iv) two elongated tabs of elasticized webbing, each fastened at one end to the yoke, one on each side of the shirt and extending out from the shirt at the top of the side opening, substantially perpendicular to an edge of the yoke that in part forms the respective side opening and for a distance less than the distance from the neck to the side opening; and each having two fasteners that are each one part of a two-part system, the two fasteners being aligned and spaced along the length of the tab; and b) an elongated protective tubular sleeve separable from the shirt, knit from a high strength cut-resistant yarn comprised of a core having a stainless steel strand 0.002 to 0.004 inches in diameter and a core of high strength stretched polyethylene of approximately 650 denier, a first wrap about the core of approximately 400 denier high strength aramid fiber, a second wrap of approximately 375 denier high strength stretched polyethylene fiber and a third wrap of approximately 440 denier polyester, said sleeve having i) an elasticized cuff portion at one end, ii) a non-elasticized other end with a placket and an elasticized tab secured at one end to the sleeve to extend across the placket and having a fastener at a free end to attach the free end to the sleeve to tighten the non-elasticized end, iii) four fasteners, each being the other part of the two-part system, secured to the sleeve at a location substantially diametrically opposite from the placket, arranged in two rows of two fasteners each, the rows being spaced peripherally about the sleeve and the fasteners of each row being spaced longitudinally of the sleeve.

2. The combination of a sleeveless shirt and a detachable cut-resistant protective sleeve for use in the meat packing industry, comprising:

a) a sleeveless shirt having i) a crew neck, ii) a single front panel and a single back panel, each substantially rectangular when flat and of a thin, light weight, low friction, wear-resistant mesh material having significant give or stretch, and stitched together to form side seams of the shirt that extend from a tail end toward an upper end and that terminate before the upper end of the shirt to provide side openings at the upper end of the shirt for a wearer's arms to extend therethrough, the front panel forming a partial boundary of the neck, iii) a single yoke panel extending the width of the front and back panels, located essentially behind the neck and forming the remaining boundary of the neck and in part forming the side openings, said yoke panel being of a woven relatively heavyweight material and relatively non-stretchable compared to the front and back panels, and iv) two elongated tabs of elasticized webbing, each fastened at one end to the yoke, one on each side of the shirt and extending out from the shirt at the top of the side opening, substantially perpendicular to an edge of the yoke that in part forms the respective side opening and for a distance less than the distance from the neck to the side opening; and each having two fasteners that are each one part of a two-part system, the two fasteners being aligned and spaced along the length of the carrying tab; and b) an elongated protective tubular sleeve separable from the shirt, having i) a cuff portion at one end, ii) an opposite end, and iii) four fasteners, each being the other part of the two-part system, secured to the sleeve adjacent said opposite end, arranged in two rows of two fasteners each, the rows being spaced peripherally about the sleeve and the fasteners of each row being spaced longitudinally of the sleeve.

3. The combination of a sleeveless shirt and a detachable cut-resistant protective sleeve for use in the meat packing industry, comprising:

a) a sleeveless shirt having i) a neck, ii) a front panel and a back panel, each of a thin, light weight, low friction, wear-resistant, mesh material having significant give or stretch, and joined together to form side seams of the shirt that extend from a tail end toward an upper end and that terminate before the upper end of the shirt to provide side openings at the upper end of the shirt for a wearer's arms to extend therethrough, the front panel forming a partial boundary of the neck, iii) a yoke panel extending the width of the front and back panels, in part forming the side openings, said yoke panel being of a woven relatively heavyweight material and relatively non-stretchable compared to the front and back panels, and iv) two elongated tabs of elasticized webbing, each fastened at one end to the yoke, one on each side of the shirt and extending out from the shirt at the top of the side opening, for a distance less than the distance from the neck to the side opening; and each having two fasteners that are each one part of a two-part system, the two fasteners being aligned and spaced along the length of the carrying tab; and b) an elongated protective tubular sleeve separable from the shirt, having i) a cuff portion at one end, ii) an opposite end, and iii) four fasteners, each being the other part of the two-part system, secured to the sleeve adjacent said opposite end, arranged in two rows of two fasteners each, the rows being spaced peripherally about the sleeve and the fasteners of each row being spaced longitudinally of the sleeve.

4. A sleeveless shirt constructed to support a detachable cut-resistant protective sleeve, for use in the meat packing industry, comprising:

a) a crew neck, b) a single front panel and a single back panel, each substantially rectangular when flat and of a thin, light weight, low friction, wear-resistant, warp knit or tricot mesh material having significant give or stretch, and stitched together to form side seams of the shirt that extend from a tail end toward an upper end and that terminate before the upper end of the shirt to provide side openings at the upper end of the shirt for a wearer's arms to extend therethrough, the front panel forming a partial boundary of the neck, c) a single yoke panel extending the width of the front and back panels, located essentially behind the neck and forming the remaining boundary of the neck and in part forming the side openings, said yoke panel being of a woven relatively heavyweight material and relatively non-stretchable compared to the front and back panels, and d) two elongated tabs of elasticized webbing, each fastened at one end to the yoke, one on each side of the shirt and extending out from the shirt at the top of the opening, substantially perpendicular to an edge of the yoke that in part forms the respective side opening and for a distance less than the distance from the neck to the side opening; and each having a fastener that is one part of a two-part system.

5. A sleeveless shirt constructed to support a detachable cut-resistant protective sleeve, for use in the meat packing industry, comprising:

a) a neck, b) a front panel and a back panel, each of a thin, light weight, low friction, wear-resistant, mesh material having significant give or stretch, and joined together to form side seams of the shirt that extend from a tail end toward an upper end and that terminate before the upper end of the shirt to provide side openings at the upper end of the shirt for a wearer's arms to extend therethrough, the front panel forming a partial boundary of the neck, c) a yoke panel extending the width of the front and back panels, in part forming the side openings, said yoke panel being of a woven relatively heavyweight material, such as cotton, and relatively non-stretchable compared to the front and back panels, and d) two elongated tabs of elasticized webbing, each fastened at one end to the yoke, one on each side of the shirt and extending out from the shirt at the top of the side opening, for a distance less than the distance from the neck to the side opening; and each having a fastener that is one part of a two-part system.

6. The combination of a sleeveless shirt and a detachable cut-resistant protective sleeve for use in protecting a wearer's arms while using sharp instruments comprising:

a) a sleeveless shirt including:

i) a front and a back of a thin, lightweight material having significant give or stretch;

ii) a yoke of a woven, relatively heavyweight and relatively non-stretchable material compared to the front and the back material;

iii) a tab secured at one end to the yoke of the shirt;

iv) one part of a two-part fastener system on the tab; and b) an elongated detachable cut-resistant protective sleeve, and the second part of the two-part fastener.

7. A sleeveless shirt according to claim 6 further including another tab secured to the other end of the yoke of the shirt, and one part of a two-part fastener system on the tab.

8. A sleeveless shirt according to claim 6 wherein the tab comprises an elasticized webbing secured at one end of the yoke of the shirt and extending out from the shirt at the top of the side opening for a distance of less than the distance from the neck to the side opening.

9. A sleeveless shirt according to claim 7 wherein the tab comprises an elasticized webbing secured at one end of the yoke of the shirt and extending out from the shirt at the top of the side opening for a distance of less than the distance from the neck to the side opening.

10. A sleeveless shirt which can be worn in conjunction with one or more attachable protective sleeves for use in the meat-packing industry comprising:

a) a front and a back of a lightweight material having significant give or stretch;

b) a yoke of a woven, relatively heavyweight and relatively non-stretchable material compared to the front and back material;

c) a tab of elasticized webbing secured at one end to the yoke of the shirt; and d) a fastener that is one part of a two-part system on the tab.

11. A sleeveless shirt constructed to support a detachable cut-resistant protective sleeve for use in the meat-packing industry comprising:

a) a neck;

b) a front and a back of a thin, lightweight, low-friction, wear-resistant material having significant give or stretch, the front forming a partial boundary of the neck;

c) a yoke extending the width of the front and back wherein the front material, the back material and the yoke are constructed to form a side opening for a wearer's arms to extend therethrough and the yoke being of a woven, relatively heavyweight and relatively non-stretchable material compared to the front and the back material; and d) a tab of elasticized webbing secured at one end to the yoke of the shirt and extending out from the shirt at the top of the side opening, for a distance of less than the distance from the neck to the side opening; and the tab having a fastener that is one part of a two-part system.

12. A sleeveless shirt according to claim 11 further including a second tab of elasticized webbing secured at one end to the yoke of the shirt and extending out from the shirt at the top of the other side opening for a distance of less than the distance from the neck to the side opening; and the tab having a fastener that is one part of a two-part system.

* * * * *